US006048594A

United States Patent [19]

Greene

[11] Patent Number: 6,048,594

[45] **Date of Patent: *Apr. 11, 2000**

[54] FILLED COMPOSITE STRUCTURE

[75] Inventor: Robert H. Greene, Lancaster, Pa.

[73] Assignee: Lancaster Composite, Columbia, Pa.

[ * ] Notice: This patent is subject to a terminal disclaimer.

[21] Appl. No.: 09/325,631

[22] Filed: Jun. 4, 1999

Related U.S. Application Data

[63] Continuation of application No. 09/013,904, Jan. 27, 1998, which is a continuation-in-part of application No. 08/770,111, Dec. 20, 1996, Pat. No. 5,800,889, which is a continuation-in-part of application No. 07/915,315, Jul. 20, 1992, abandoned.

[51] Int. Cl.[7] ..... B29D 22/00

[52] U.S. Cl. ..... 428/36.91; 428/36.4; 428/34.5; 52/722; 52/723; 52/724; 52/725

[58] Field of Search ..... 428/36.91, 34.5, 428/36.4; 52/722, 723, 724, 725; 106/772

[56] References Cited

U.S. PATENT DOCUMENTS

| | | | |
|---|---|---|---|
| 3,957,250 | 5/1976 | Murphy . | |
| 4,157,263 | 6/1979 | Gaines et al. . | |
| 4,939,037 | 7/1990 | Zion et al. . | |
| 5,770,276 | 6/1998 | Greene | 428/36.91 |
| 5,800,889 | 9/1998 | Greene | 428/36.91 |

*Primary Examiner*—Michael A. Williamson
*Attorney, Agent, or Firm*—Farkas & Manelli Stemberger, E.J.

[57] ABSTRACT

A filled structure includes a fiber reinforced resinous hollow structure having a tensile strength of at least 30,000 psi, an inside surface forming a boundary which encloses a space, and a hard core within the space. The hard core has a density of at least 35 pounds per cubic foot and a compressive strength of at least 1500 psi. The hard core is formed from a mixture of particulate cementitious material and liquid such that when the mixture hardens, the hard core is mechanically locked to the inside surface of the hollow structure.

12 Claims, 3 Drawing Sheets

FILLED COMPOSITE STRUCTURE

This is a continuation of my U.S. application Ser. No. 09/013,904 filed Jan. 27, 1998, which is a continuation-in-part of my U.S. application Ser. No. 08/770,111 filed Dec. 20, 1996 (U.S. Pat. Ser. No. 5,800,889), which is a continuation-in-part of U.S. application Ser. No. 07/915,315, filed on Jul. 20, 1992, now abandoned.

BACKGROUND OF THE INVENTION

This invention deals generally with stock material, and more specifically with filled hollow structures such as light poles, fence posts and pilings constructed of plastic or fiberglass.

The benefits of plastic and fiberglass for articles which are used where they are subject to corrosion are generally well recognized. Structures using such materials are light weight, strong and attractive. They can be made with color integrated into the material so that they do not need frequent painting during their use, and possibly their greatest asset is the inherent chemical resistance of the material. A fiberglass or plastic structure such as a fence post can be expected to last as long as anyone wants it to, even in the most severe environment, with no sign of deterioration, and it will not require any maintenance.

Unfortunately, the major limitation on the availability of such pole type fiberglass or plastic structures has been the cost and difficulty involved in their manufacture. One typical method of fiberglass construction is the forming of the fiberglass into a specific shape by wrapping multiple layers of fiberglass fabric on the outside of a core and impregnating the fabric with resin or epoxy, however such manufacturing methods are very expensive because they involve a great deal of hand labor.

Another approach, particularly to the construction of cylindrical structures, is to use preformed fiberglass or plastic pipe. However, such pole structures are not strong enough for most applications unless the pipe is very thick or the structure includes wood or metal reinforcing, and both of these approaches raise the cost of fiberglass and plastic poles so that they are not competitive with conventional metal poles.

One approach to reinforcing fiberglass or plastic pipe so it can be used as a structural member has been the use of fillers which are poured into the inside of the pipe, and then harden into a core. Fillers have been suggested which include wood with an adhesive binder (U.S. Pat. No. 4,602,765 by Loper) and rigid foam or concrete (U.S. Pat. No. 3,957,250 by Murphy), but these approaches do not furnish strength comparable to metal poles.

Accordingly, there is a need to provide a fiber reinforced pole filled with a cementitious material to provide a piling having strengths similar to that of a steel piling.

SUMMARY OF THE INVENTION

An object of the invention is to fulfill the need referred to above. In accordance with the principles of the present invention, this object is attained by providing a filled structure characterized by the combination of high compressive strength and tensile strength to allow a high bending load. The filled structure includes a fiber reinforced resinous hollow structure having a tensile strength of at least 30,000 psi, an inside surface forming a boundary which encloses a space, and a hard core within the space. The hard core has a density of at least 35 pounds per cubic foot and a compressive strength of at least 1500 psi. The hard core is formed from a mixture of particulate cementitious material and liquid such that when the mixture hardens, the hard core is joined securely to the inside surface of the hollow structure.

Other objects, features and characteristics of the present invention, as well as the methods of operation and functional of the related elements of the structure, the combination of parts and economies of manufacture, will become more apparent upon consideration of the following detailed description and appended claims with reference to the accompanying drawings, all of which form a part of the specification.

DETAILED DESCRIPTION OF THE INVENTION

Figure 1:
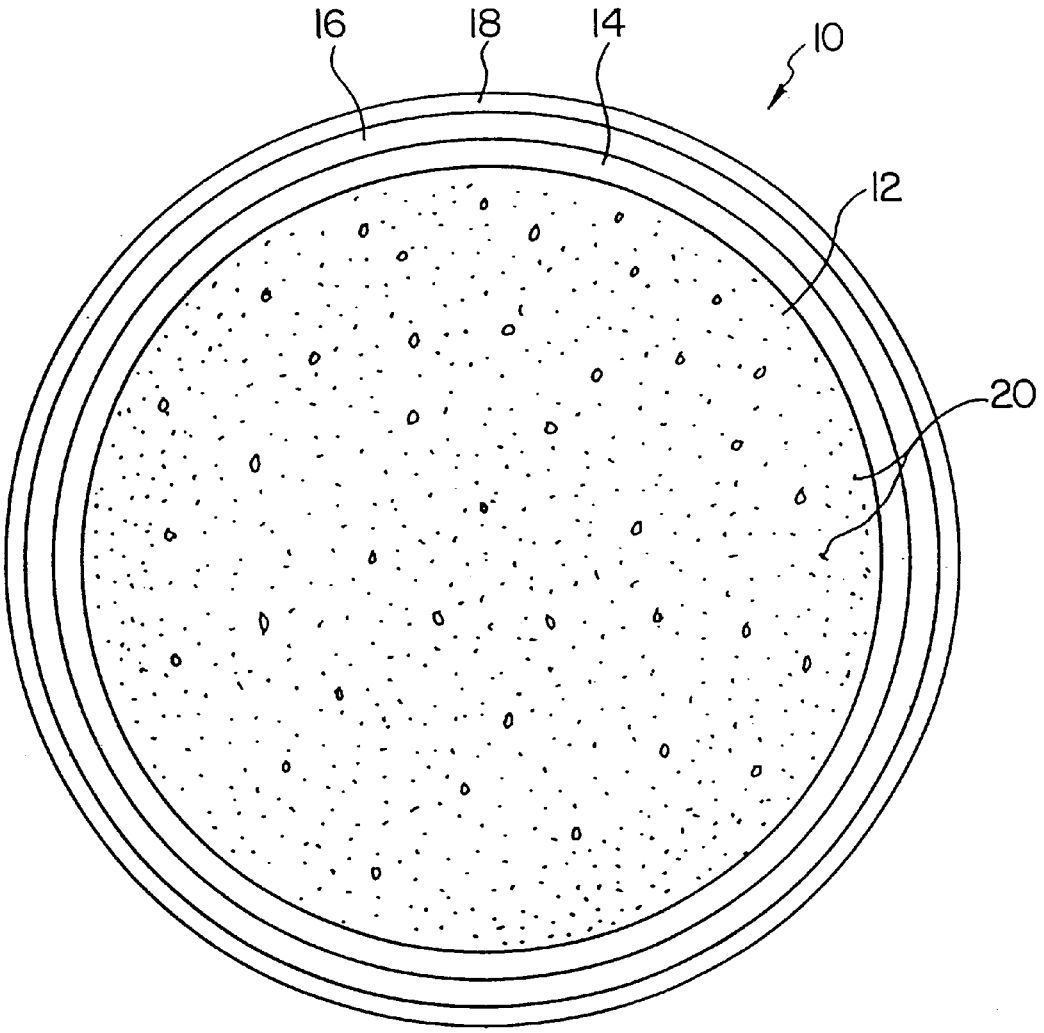
FIG. 1 is an end view across the axis of an embodiment of the invention.

FIG. 1 shows an end view across the axis of pole 10 of an embodiment of the invention. Pole 10 is preferably formed of four distinct materials, one of which, core 12, takes on a particular significance because of the manner in which it is formed. Core 12 is encased within pipe 14 which is covered by veil 16, on top of which is placed protective surface coating 18. Each of the four parts of composite pole structure 10 adds a particular characteristic to the pole structure, and together they furnish a pole of superior strength and durability which can be produced economically. In the broadest aspect of the invention, the veil 16 and coating 18 need not be provided.

The construction of pole 10 is essentially based upon the filling of pipe 14 with core 12, but core 12 has unique properties which produce a non-metallic pole with strength equivalent to that of steel poles. Core 12 is a Portland cement based product with admixtures which enables the mixture to expand as it hardens, or at least limit shrinkage of the mixture as it hardens.

In one embodiment of the invention, it is important that the core material normally expand in order that it have a permanent positive stress and produce a force fit with exterior pipe 14. It is also vital that the hardened core have significant strength, which is best indicated by a compressive strength rating of at least 1500 psi, so that it adds significant strength to the structure and does not act to merely fill the interior space of the pipe. The load/force developed as the core 12 hardens must, however, be less than the structural strength of pipe 14 in order to prevent the forces produced by the attempted expansion during hardening of core 12 from distorting and/or substantially weakening pipe 14 as it restrains the expansion of core 12.

In a preferred embodiment, cylindrical pipe 14 has a two inch outer diameter with 0.030 inch wall thickness up to a ninety-six inch diameter with at least 0.500 inch wall thickness. The pipe 14 is constructed with a standard polyester, epoxy or vinyl ester resin base, reinforced with fibrous roving, chop, or woven mat throughout its entire thickness. Such a material has a tensile strength of at least 30,000 psi. Added bending strength can be attained if the significant portion of the fibrous roving are oriented to be at an angle of at least 45 degrees to the axis of the pole or oriented generally along the axis of the pole. The fibrous rovings in the illustrated embodiment is fiberglass. It can be appreciated that other fibrous rovings such as carbon, etc. may be used.

As with all fiberglass and resin structures, color pigments may be added during manufacture of pipe 14 to produce consistent color throughout the entire pipe.

It is also advantageous to produce veil 16 on the exterior surface of pipe 14 when it is being manufactured. Veil 16 is a layer of polyester or other material cloth impregnated with resin. The production of such a veil is well understood by those skilled in the art of fiberglass construction. Veil 16 protects the fiberglass against ultraviolet radiation, provides a moisture barrier, protects against blooming of the surface fibers of the fiberglass and also adds strength to pole 10.

The core 12 is composed primarily of a mixture of stone, sand, water, and Portland-type cement. In one embodiment of the invention, the specific material used is Type I Portland-type cement as manufactured by the Lehigh Cement Co. The stone component could be solid limestone, as commonly found at may local quarries, or lightweight type aggregate as produced, for example, by Solite Corp. The sand component is clean washed and specifically graded round silica material as is available from many local sand quarries. Normal potable water is used and other cementitious products may be employed to promote expansion or at least limit shrinkage of the core upon hardening. For example, expansion additives such as INTRAPLAST N manufactured by Sika (plastic state expansion), or CONEX, as manufactured by IM Cement Co. (early hardened state expansion) may be used in the core. Alternatively, a standard expansion agent such as alumina hydrate may be employed in the core, or the core may comprise Type K cement.

When hardened this formula yields a compressive strength of 1500–15,000 psi. Moreover, one particular formula normally expands about 0.1–10 percent upon hardening, except that it is restrained by the hollow tube 14 and therefore provides an exceptionally strong force fit with hollow tube or pipe 14. The density of such a core is at least 35 pounds per cubic foot. Instead of expanding, the mixture may be formulated such that shrinkage is limited or made to be generally negligible, unlike shrinkage which may occur in normal cement-type products.

Protective coating 18 may also be added to pole 10, for the purpose of enhancing ultraviolet protection and corrosion resistance and to produce a smooth surface. The coating 18 is applied during the manufacture of the pipe and is at least 0.001 inch thick. Protective coating 18 is clear, can be made with or without pigments, and includes specific ultraviolet absorbers and/or shields. An example of such a coating could be "Amerishield" as manufactured by Ameron Corp. or "Tufcote" as manufactured by DuPont.

The composite pole of the present invention can furnish bending strength equal to or greater than Schedule 40 steel pipe (ASTM F- 1083) of the same diameter, and its inherent corrosion resistance is far superior to that of steel. Moreover, the present invention actually furnishes a pole which will flex more than twice as far as steel and return to its original shape without failure.

Figure 2:
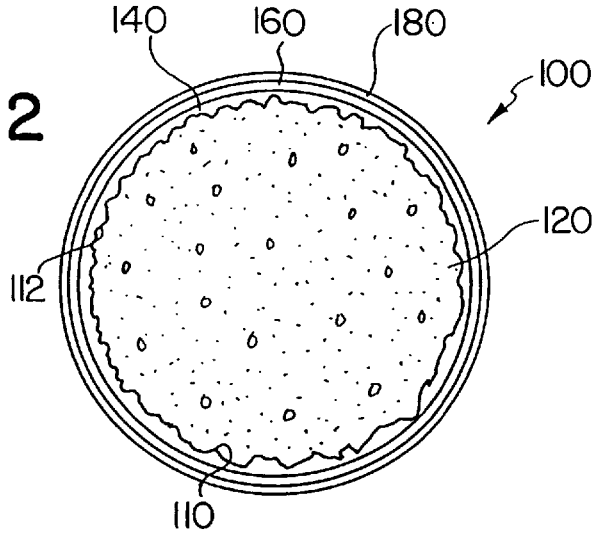
FIG. 2 is an end view across the axis of another embodiment of the invention.
Figure 4A:
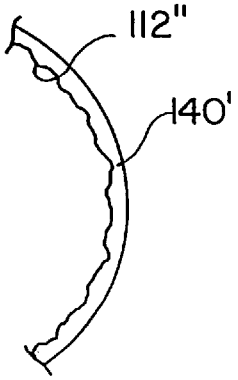
FIG. 4*a* is a partial end view of concave ridges formed in a pole of the invention.
Figure 4B:
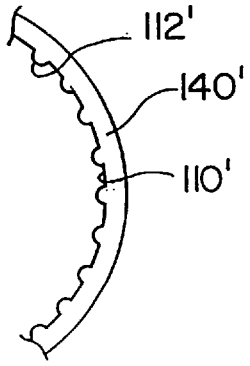
FIG. 4*b* is a partial end view of convex ridges formed in a pole of the invention.

FIG. 2 shows another embodiment of a composite pole structure 100 of the invention. As shown, the inner surface 110 of the pipe 140 is roughened to form a regular or irregular pattern therein. In the illustrated embodiment, the inner surface 100 includes an irregular pattern defining a plurality of recesses 112 which increases the surface area contact between the core 120 and the pipe 140 when the core 120 hardens within in the pipe 140. Thus, a portion of the core 120 is disposed in the recesses 112 defining a mechanical lock between the core 120 and the pipe 140. The core 120, pipe 140, veil 160 and coating 180 are otherwise identical to the embodiment of FIG. 1. Alternatively, as shown in FIGS. 4*a* and 4*b*, instead of the recesses, ridges 112' or 112 can be molded or otherwise formed into the inner surface 110 of the pipe 140'. The ridges may be concave 112' (FIG. 4*a*) or convex 112' FIG. 4*b*) and may be in a regular or an irregular pattern. It can be appreciated, however, that the core 120 need not be of the type which expands its volume when it hardens to provide a force fit with the pipe 140, since the mechanical lock provides the desired locking of the core 120 to the pipe 140. Thus, a conventional type cement material may be employed as the core material in this embodiment of the invention. It can also be appreciated that the core material may be of the type discussed above, in which shrinkage is limited during hardening thereof.

Figure 3:
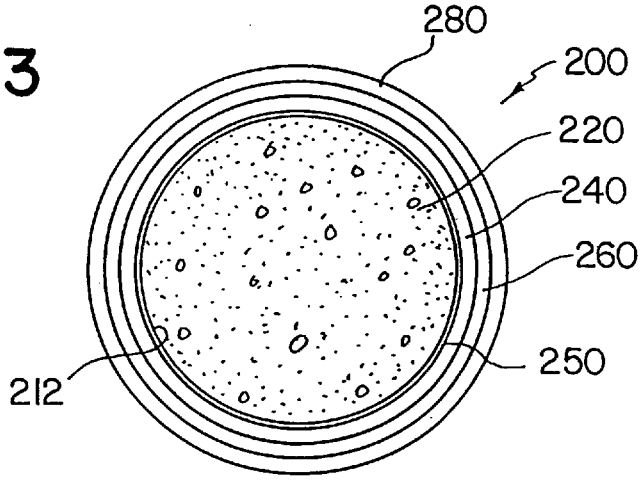
FIG. 3 is an end view across the axis of yet another embodiment of the invention.

FIG. 3 shows yet another embodiment of a composite pole structure 200 of the invention. As shown, an adhesive 250 is coated on the inner surface 212 of the tube 240 such that when the core 220 hardens it is chemically locked with respect to the pipe via the adhesive 250. The adhesive 250 is preferably SIKADUR 32® manufacture by Sika. However, any type of adhesive suitable for securing the resin pipe 240 to the hardened core may be employed. The core 220, pipe 240, veil 260 and coating 180 arc identical to the embodiment of FIG. 1. It can be appreciated, however, that the core 220 need not be of the type which expands its volume when it hardens to provide a force fit with the pipe 240, since the chemical lock provides the desired locking of the core 220 to the pipe 240. Thus, a conventional type of cement material may be used as the core material in this embodiment of the invention. It can also be appreciated that the core may be of the type discussed above, in which shrinkage is limited during hardening thereof.

Tests were performed to determine the push-out strength or frictional resistance of the core material to the inner wall of the composite pole structure. The total load in pounds required to dislodge the core from the hollow tube was measured and divided over the unit area and represented in units of psi. The average frictional resistance of the core made in accordance with the embodiment of FIG. 1, (no mechanical or chemical locking of the core) was measured to be on average 25 psi over the entire inner wall surface of the pipe. With the addition of an adhesive 250 bonding the core 220 to the pipe 240 (FIG. 3) the average frictional resistance of the core was determined to be approximately 90 psi. Thus, there is a corresponding minimum increase in bending strength of approximately 30% as a result of a better bond between the core and the pipe which provides for a better transfer of shear between the structural component parts. With both expansion of the core 220 and the use of the adhesive 250 (FIG. 3), failure of the composite structure is often in the cohesive strength of the core 220 itself. Namely, the cohesive strength of the bond between the core and pipe can be stronger than the cohesive strength of the core 220.

Additives 20 may be included in the core of the invention to improve the composite pole structure. For example, silica fume, an extremely fine aggregate that fills tiny voids in the core may be added to the core to improve the compressive thus, making he composite pole structure even stronger. Steel, glass or polymer fibers additives mixed into the core could also be employed. The fibers deter cracking which cause premature failures, provide higher stiffness, provide higher compressive strength and provide higher bending strength, all of which enhance the performance of the composite pole structure.

Figure 5A:
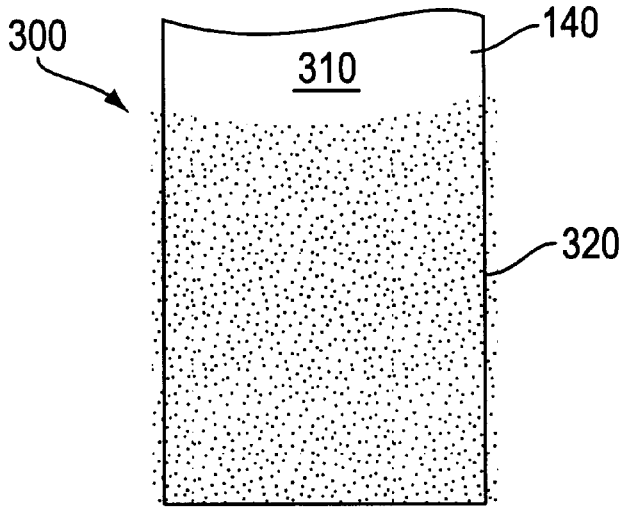
FIG. 5*a* is a front view of a lower portion of another embodiment of the invention showing an abrasive adhesive coating thereon.
Figure 5B:
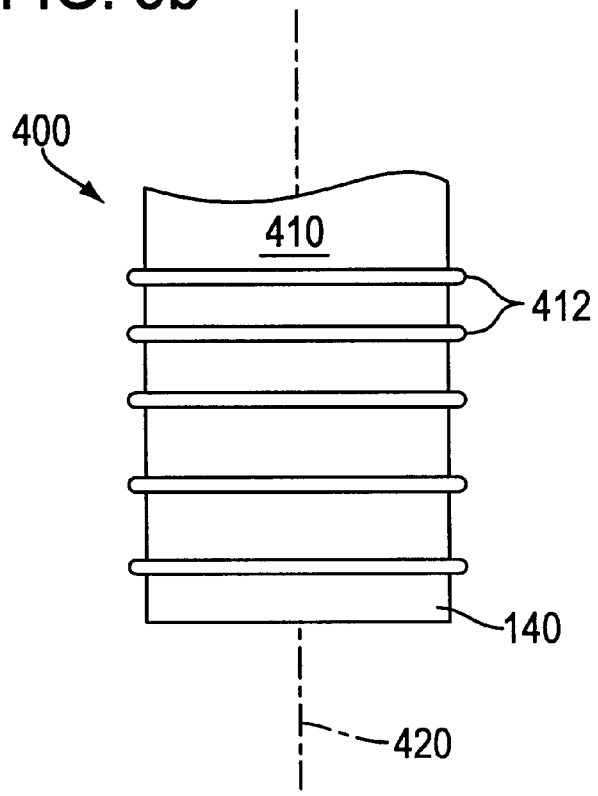
FIG. 5*b* is a front view of a lower portion of another embodiment of the invention, showing fiber rovings wrapped so as to extend from an outer surface thereof.

FIGS. 5*a* and 5*b* show other embodiments of the invention, each having a roughened portion on at least a portion of an outside surface of at least one of the ends of the filled structure. It can be appreciated that the poles or filled structures of FIGS. 5*a* and 5*b* may be configured as disclosed in any of the embodiments of FIGS. 1–4*b*, but also include a roughened portion on an outside surface thereof, as explained below.

As shown in FIG. 5*a*, the fiber reinforced pipe 140 of pole 300 has an outer surface 310. In the illustrated embodiment, the outside surface 310 includes an abrasive adhesive 320 coated on at least one end of the pole 300. The abrasive adhesive 320 includes an abrasive such as a grit material, e.g., sand, in an epoxy, and defines a roughened portion on the outside surface 310. When the pole 300 is driven into the ground, the roughened portion creates skin friction with the ground which increases the bearing load capabilities of the pole 300 as compared to that of a smooth pole. Thus, the pole 300 may be relatively shorter than traditional material pole (smooth steel and/or concrete poles) since it does not have to be driven as deep as the traditional poles to achieve the same load bearing. The abrasive adhesive defining the roughened surface works well in mounting the pole 300 in sandy ground, particularly when the size of the grits of the abrasive closely match the size of the grits of sand in the ground.

FIG. 5*b* shows a pole 400 having a plurality of fiber rovings 412 wrapped about a lower portion of the fiber reinforced pipe 140 so as to extend from outside surface 410 thereof. Each of the fiber rovings 412 may be a singular fiber roving strand or may comprise a group of smaller roving strands. Thus, during manufacture of the fiber reinforced pipe 140, the fiber rovings 412 may be wrapped to extend from the outside surface 410 and cured to be integral with the pipe 140. In the illustrated embodiment, the fiber rovings 412 are disposed in spaced relation thereby defining a roughened portion on the outside surface 310. The fiber rovings 412 may be evenly or unevenly spaced. Further, the fiber rovings 412 are arranged so as to be generally perpendicular to the longitudinal axis 420 of the pole 400 so as to create more driving friction than would be created if the rovings 412 were more vertically oriented with respect to the longitudinal axis 420. The fiber rovings 412 create increased skin friction when driven into the ground, resulting in the advantages noted above, with reference to the embodiment of FIG. 5*a*. The fiber rovings 412 have been found to provide a pole having good load bearing capabilities in muddy soil or clay.

In the illustrated embodiments, only a portion of poles 300 and 400 near an end thereof is roughened since one end portion is typically driven into the ground when the pole is used as a piling. In piling applications under water, the portion of the pole exposed to water is preferably smooth to prevent biological attack from mollusks, barnacles and the like, which have a more difficult time attaching to a smooth surface.

Although two examples of surface roughening have been described above, it can be appreciated that the pole of the invention may be roughened any amount to produce increased skin friction with the ground.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For instance, structures may be produced without either veil 14 or protective coating 16 when the application does not require ultraviolet protection. Moreover, the diameter and cross sectional configuration of the external member may, of course vary, and the particular formula of the core could be changed as long as the requirements of the claims are retained. Further, although a generally round cross-sectioned pipe is disclosed, the composite structure may be in any shape or closed section, such as, for example a square, rectangular, oval etc, cross-section.

What is claimed is:

1. A filled structure characterized by the combination of high compressive strength and tensile strength to allow a high bending load, the filled structure comprising:

a fiber reinforced resinous hollow structure having a tensile strength of at least 30,000 psi, and an inside surface forming a boundary which defines a space, and a hard core within said space, the hard core having a density of at least 35 pounds per cubic foot and a compressive strength of at least 1500 psi, the hard core being formed from a mixture of particulate cementitious material and liquid such that when said mixture hardens, said hard core is joined securely to said inside surface of said hollow structure.

2. The filled structure of claim 1, wherein said mixture is such that it expands its volume as it hardens, expansion of the mixture being restrained by the hollow structure and the hard core exerts a force against the inside surface of the hollow structure.

3. The filled structure of claim 1, wherein the hollow structure is a closed section.

4. The filled structure of claim 1, wherein the hollow structure is a cylindrical pipe having fiberglass rovings therein.

5. The filled structure of claim 1, wherein the mixture from which the core is formed includes a Portland cement.

6. The filled structure of claim 5, wherein the mixture from which the core is formed includes stone, sand, water, Portland cement and an additive which causes expansion of the mixture as it hardens.

7. The filled structure of claim 1, further including a coating attached on the outside of the hollow structure with the coating comprising a material which absorbs or shields ultraviolet radiation.

8. The filled structure of claim 1, wherein said hard core includes material therein selected from the group consisting of silica fume, metal, glass and polymer fibers.

9. The filled structure of claim 1, wherein said hollow structure has fiber rovings throughout an entire thickness thereof.

10. The filled structure of claim 1, wherein said hard core is of material such that shrinkage thereof is negligible upon hardening.

11. A filled structure characterized by the combination of high compressive strength and tensile strength to allow a high bending load, the filled structure comprising:

a fiber reinforced resinous hollow structure having a tensile strength of at least 30,000 psi, and an inside surface forming a boundary which defines a space, and a hard core within said space and engaged with said inside surface, the hard core having a density of at least 35 pounds per cubic foot and a compressive strength of at least 1500 psi, the hard core being formed from a mixture of particulate cementitious material and liquid.

12. The filled structure according to claim 11, wherein said mixture is such that it expands its volume as it hardens, expansion of the mixture being restrained by the hollow structure and the hard core exerts a force against the inside surface of the hollow structure.

* * * * *